US006682448B2

(12) United States Patent
Jamison

(10) Patent No.: US 6,682,448 B2
(45) Date of Patent: Jan. 27, 2004

(54) PLAY DEVICE

(76) Inventor: Bradford C. Jamison, 3310 Martin La., Hellertown, PA (US) 18055

( * ) Notice: Subject to any disclaimer, the term of this patent is extended or adjusted under 35 U.S.C. 154(b) by 0 days.

(21) Appl. No.: 09/840,780

(22) Filed: Apr. 25, 2001

(65) Prior Publication Data

US 2002/0032087 A1 Mar. 14, 2002

Related U.S. Application Data

(63) Continuation-in-part of application No. 09/272,195, filed on Mar. 18, 1999, now abandoned.

(51) Int. Cl.[7] ..... A63B 65/02
(52) U.S. Cl. ..... 473/579; 473/582; 473/585
(58) Field of Search ..... 473/578–580, 473/FOR 216, FOR 217

(56) References Cited

U.S. PATENT DOCUMENTS 2,192,180 A * 3/1940 Collier ..... 473/579
2,193,645 A * 3/1940 Raizen et al. ..... 473/579
2,613,935 A * 10/1952 Richards ..... 473/579
2,734,746 A * 2/1956 Sametz et al. ..... 473/579
D186,848 S * 12/1959 Diercks ..... D21/711
3,089,704 A * 5/1963 Wolf ..... 473/579
3,507,494 A * 4/1970 Finkel ..... 473/526
4,082,281 A * 4/1978 Chen ..... 473/579
4,101,128 A * 7/1978 Yellen ..... 473/459
4,538,818 A * 9/1985 Sinclair ..... 473/579
5,421,587 A * 6/1995 Mao-Huang ..... 473/579

* cited by examiner

*Primary Examiner*—Paul T. Sewell
*Assistant Examiner*—Mitra Aryanpour

(57) ABSTRACT

A play device designed to be struck by various parts of the human anatomy, or with rackets or paddles, depending on the size of the play device. The tail portion of the play device, consists of a curved bell shaped structure, constructed from a suitable molded plastic or a composite of materials; which allows for a strong, flexible, lightweight tail. The length of the tail portion forms a parabolic curve, which increases the compression strength of the tail, as well as increases the drag the tail lends to the device while in flight. The tail portion of the device is connected to a substantially round striking(head)portion. The proportions and weight characteristics enable the shuttle to quickly recover to a head first stable flight pattern, thereby enabling a player to repeatedly strike the device, with the intention of sustaining it's flight.

5 Claims, 16 Drawing Sheets

PLAY DEVICE

CROSS-REFERENCE TO RELATED APPLICATION

This application is a continuation-in-part and claims the benefit of U.S. patent application Ser. No. 09/272,195, filed Mar. 18, 1999, now abandoned.

BACKGROUND OF THE INVENTION

1. Field of the Invention

The present invention relates to sport games, and more particularly a portable game court and game in which opposing players return a play device in a court that is defined by adjustable opposed rings, longitudinal side ropes and a transverse center rope. The adjustable opposed rings can be sized according to the height, skill or ability of a player, to equalize the competition during play. The play devices which are functional with or without the court have a relatively lightweight, substantially round head connected to a tail portion which flairs down and outward from the head to form a thin, lightweight, curved bell shaped, mesh structure. The curvature of the bell shaped tail portion when viewed from the side closely follows the curve formed by a parabolic arc. The head is designed to be hit by player's hands, feet, head, or any other part of the human body. The aforementioned devices are also suitable for use with rackets, paddles, or other striking instruments. The head portion may be produced from a soft foam material. The head absorbs the impact from striking implements, thereby reducing the force from which, and distance to which, the play implement may be directed by a striking instrument. The tail portion serves as a wind drag, further limiting the distance to which a striking implement may cause the play device to travel. The shape and size of the present invention lends itself to being thrown and caught much the same as a football might be. The lightweight, soft foam head, and short flight pattern combine to make a play device suitable for practicing many different physical coordination skills, indoors or within confined spaces.

2. Description of Related Art

Various game assemblies for games employing a court have been developed in the past. However, innumerable disadvantages can be described which detract from the enjoyment and fairness of play of any given game employing a court and its associated defining equipment (nets, goals, rackets, etc.).

In the related art, the court is generally dedicated to a given location with a dedicated size, having dedicated devices such as boundary lines, dividers (e.g. nets) or scoring goals. Furthermore, some courts require surfaces with improved playing characteristics (such as tennis, basketball or volleyball) which require more than a minimum of expense to build or maintain. Such courts are therefore, first, not transportable. Moreover, such courts, sometimes having a target zone or goal at which a player must practice accurate hitting, may not be conveniently accessible to a user wishing to practice, thus limiting the court's use mostly to play and not to practice. Finally, none such courts are readily reduced or increased in size to accommodate a handicap (whether it be a sports handicap or a physical handicap), without seriously affecting or interfering with the rules of play.

Likewise, the dedicated devices associated with such courts present added problems. Even if the boundaries, goals or dividers are not fixed, they are generally exacting and time consuming to erect (as in the case of laying out lines) or bulky and cumbersome to transport or erect (as in the case of hockey or basketball goals). Moreover, devices used to define the court into separate playing areas (such as volleyball nets or opposing basketball goals). Moreover, devices used to define the court into separate playing areas (such as volleyball nets or opposing basketball goals) are usually elevated above the ground and thus intended for ambulatory individuals without handicap or height limitations. Thus, such devices are generally ill suited to accommodate physical limitations of the individual, whether due to age, or physical handicap, wherein a change to the court or associated equipment fails to make the game playable as intended or fails to neutralize the limitation of one opposing player as between unequally skilled players. At best, very few such game devices are readily height adjustable and, although lowering or decreasing the size of the device, they fail to relate such change to the size of the court; i.e. the court remains the same size. At worst, most are entirely unadaptable and thus remain dedicated to play by a few.

Ultimately, any combination of such courts' features results in disadvantages which make it very difficult for those unable to freely come and go or move about, such as children or the handicapped, to enjoy recreational court games. Therefore, a portable court game is desired wherein neither the mobility of a user, the ease of play, nor the fairness or play, is restricted by the typical characteristics of a court. In particular, a game is desired having a court which is adjustable and in part dependent upon the height or other sports handicap of the players playing the game.

Moreover, the implements used during play of recreational court games have undesirable qualities which detract from the fun of play. For example, scoring implements used, such as balls or pucks, may require containment from escape from the immediate court side areas (most notably as in tennis) or otherwise cause the players to suffer the annoyance of retrieval, where-as the present invention does not require containment as is not able to roll great distances, because the expanded end of the tail portion has a diameter that is approximately twice that of the head portion causing the device to roll in a circular direction. Moreover, the striking implements used, for example rackets often used in court games for returning a birdie or a shuttlecock, may not be immediately effective in the hands or a user, therefore requiring undue skill, strength, practice or muscular coordination before being able to participate in regular play. Such disadvantages may arise due to the arrangement of the string area, e.g. the size and location of the "sweet spot", or its proximity to the neck of a racket. Also, the birdies of the relevant art do not describe a play device with a tail portion which along it's length closely follows the curved path described by the equation used to form a parabolic arc. The impact strength of the tail portion is increased by the curvature of the tail portion as well as the manner in which it intersects the head. The mesh structure of the tail portion, where it is connected the head is nearly cylindrical, and runs nearly parallel to the direction of impact upon the head's surface by striking implements. The curvature of the tail portion also increases the wind resistance of the tail portion, there-by providing the desired arc of declination for a play device, or a shuttlecock used in the game of badminton. The increased impact strength of the tail portion of the present invention allows the tail to be produced lighter in weight than previous designs have allowed, therefor the present invention is able to provide a shuttlecock or play device with a more desirable arc of declination due to the fact that the arc of declination of a play device is largely influenced by the weight of the tail portion. Present injection molding techniques and materials would not allow shuttlecocks described by previous art to be produced light and strong enough to provide a desired arc of declination in contrast with the present invention where the head, skirt, and tail ring combine to produce a desirable arc of declination within the flight path of the play device.

Various patents in the relevant art have described both striking and struck implements used in court games, or the games themselves. U.S. Pat. No. 5,470,061 issue to Colburn et al. On Nov. 28, 1995 describes a racquet. The racquet does not have the widest area closest to the throat portion of the racquet, thereby limiting a player's ability to respond quickly and accurately, to play devices that are hit directly at them.

U.S. Pat. No. 2,761,685 issued to Lashley on Sep. 4, 1956 describes a shuttlecock. The shuttlecock has a skirt that includes sets of strands which superimpose one another. However, it has not been disclosed that a tail portion of a play device be produced by having forms pass through a tube around which the tubular fabric is disposed and where upon exiting the tube the forms would engage an end of the tubular fabric, and pull the material from the tube through an epoxy bath, thereby disposing the composited material upon the forms where it would cure and form a composite mesh structure used for the tail portion of a shuttlecock or play device.

U.S. Pat. No. 5,072,947 issued to Blue on Dec. 17, 1991 describes a game court that has netted target areas held above ground level which divide the court into two playing areas. The target areas or goals are not convenient or accessible to children or the handicapped and thereby limit participation in play. Moreover, the court is not easily transportable.

Other patents of interest include U.S. Pat. No. Des. 163,368 and U.S. Pat. No. Des. 163,369 issued to Carlton both on May 22, 1951; U.S. Pat. No. 4,078,795 issued to Porter on Mar. 14, 1978; U.S. Pat. No. 5,238,247 issued to Davis on Aug. 24, 1993; U.S. Pat. No. 5,277,422 issued to Coe on Jan. 11, 1994; U.S. Pat. No. 5,374,058 issued to Janes et al. On Dec. 20, 1994; U.S. Pat. No. 5,615,890 issued to Blue on Apr. 1, 1997; U.S. Pat. No. 5,421,587 issued to Mao-Huang on Jun. 6, 1995; U.S. Pat. No. 227,884 issued to Duchemin on May 25, 1880; U.S. Pat. No. 1,921,523 issued to Hart on Aug. 8, 1933; U.S. Pat. No. 2,193,645 issued to Raizin et al. On Mar. 12, 1940; U.S. Pat. No. 2,509,087 issued to Edmund on May 23, 1950; U.S. Pat. No. 2,613,935 issued to Richard on Oct. 14, 1952; U.S. Pat. No. 3,834,705 issued to Wong on Sep. 10, 1974; U.S. Pat. No. 4,294,447 issued to Clark on Oct. 13, 1981; U.S. Pat. No. 4,538,818 issued to Sinclair on Sep. 3, 1985; U.S. Pat. No. 5,269,527 issued to Noval on Dec. 14, 1993; and PCT WO 84/00306 issued to Vetling on Feb. 2, 1984.

None of the above inventions and patents, taken either singly or in combination, is seen to describe the instant invention as a device designed to be hit with a practitioner's hands, feet, or other parts of the body. Nor do they disclose the ability to be used as practice throwing or catching devices as their size and weight do not readily proffer themselves as caching and/or throwing implements. There are of course many different types of throwing and catching implements, though none would claim to be configured to have the ability or desirability to be struck with the intention of directing the object to land and remain stable upon a player's head, which is an ability and method of play used in conjunction with an embodiment of the present invention.

SUMMARY OF THE INVENTION

The present invention is directed towards a play device, portable court assembly and games, an object of a game is for opposing players to volley the play device and cause it to land in the opponent's target zone to score. Depending on the embodiment of the device used for play, each player uses either a racket or any body part for volleying.

Accordingly, it is a principal object of the invention to provide a sporting game for players of any age, skill or ability in which an object is volleyed from one opponent's target area into an opponent's target area of the court, wherein the court structure may be adjusted in size to correspond to varying levels of skill between opponents.

It is another object of the invention to provide the court with opposed circular rings, wherein each ring is scaled for adjusting the ring so as to match the player's height and ability.

It is a further object of the invention to provide a court that is easy to assemble, transport and access.

Still another object of the invention is to provide a shuttlecock, with an improved impact strength; while reducing the weight of the tail portion; to achieve this, the length of the tail closely follows a curved line which is described by a parabolic equation, this decreases the angle to which the tail leaves the head, thus maximizing the impact strength of the tail portion of a play device or shuttlecock. Another object is to provide a shuttlecock that has an additional thickness formed at the bottom portion of the cap so as to improve the shuttle's bounce, weight characteristics, and durability.

Yet another object of the invention is to provide a play device in which a player makes use of one's body parts to strike and volley the device. These play devices have a foamed rubber or foamed plastic head for softness and to keep the weight of the head at a minimum. The foam heads may have an internal inflatable bladder for additional bouncing effect, or the heads may be produced from an inflatable material connected directly to the tail portion. The object of this form of the invention is to provide a player with a ball that can be painlessly hit hard with bare feet and hands; due to it's light weight and it's foam head. The object of providing a device whose speed and flight pattern enhance the potential of a player's control over and ability to retain the object in flight; by striking it; is readily achieved by a disclosed play implement having an open end of the tail portion with a diameter that is equal to or greater than six inches, and where the height of the tail portion, would be approximately equal to the greatest width of the tail.

To provide for a tail portion that can withstand repeated impact from rackets or body parts and also withstand the general rigors of play; by children, i.e., being crushed, crumpled and used as a "tug of war" device, the devices must remain flexible, tear resistant and retain "memory" of their original shape. To accomplish the goals of durability and impact strength the development of a new type of braid or tubular woven material was created; this new braid or "heliweave" is produced by strands of material being interconnected by twisting around their neighboring strands of fibers along the length of the fabric being produced. This type of braid has advantages over a regular braided material; one advantage is that the fibers twist around one-another as opposed to laying on top of one-another, this allows for the production of a braid with strands which are not easily displaced even when the braid is loosely woven with an open pattern weave similar to a fishnet. A regular braid becomes unstable with fibers that are easily displaced when braided loosely with space between the fibers, while the "heliweave" remains stable and the area between the fibers remains constant even when pulled over irregular shaped forms. The "heliweave" also has other advantages over a regular braid; when used within a composite structure, or as plain fabric or rope. Heliwoven rope has increased abrasion resistance qualities; as the external fibers which make up the rope, run parallel to the length of the rope increasing it's linear abrasion resistance; where regular braided rope has fibers which run at a 45 degree angle to the length of the rope. Heliwoven material, combined with polymers, creating a composite structure, has advantages over a regular braid; the linear, compression, and impact strength of a heliwoven composite structure is improved; in part due to the increased surface area of the connection between individual fibers. The linear strength of a composite heliwoven rod, is increased; due in part to the fact that heliwoven rope or cord, creates a solid rod, as opposed to a hollow tube that a regular braid produces. Decorative heliweaves may also be produced; which would have desirable esthetic qualities. The Heliweave may be braided flat or in circular shape and has other applications and advantages above and beyond the ones described herein.

Yet another object of the invention is to provide an improved racket, wherein the racket has a widest area closest to a throat portion of the racket's frame for quicker and more accurate responses when the player returns a volley.

It is an object of the invention to provide improved elements and arrangements thereof in an apparatus for the purposes described which is inexpensive, dependable and fully effective in accomplishing its intended purposes.

The game is played within a court boundary defining opposite target zones. The court boundaries are defined by a structure that comprises opposed and adjustable circular rings, longitudinal side lines joining each ring at opposite points on its diameter, and a center line transversely extending between the side lines. Each of the lines may be defined by ropes or a similar material such as nylon, attached to each ring. Each side rope constitutes the court's side boundary. The transversely extending rope marks a center of the court, thus dividing the court into first and second playing areas.

Each ring is adjustable in diameter; two embodiments are described, adjustable by means permitting the free and slidable movement of each free end past another, such by means of a sleeve or banding loop, or by means permitting insertion of one tube into the other. The rings are adjustable from 7 to 14 feet in diameter, each ring also being scaled to permit the adjustment of the ring to conform to the height or ability of a player, thereby permitting players of unequal skills or ability to compete with one another.

Each ring comprises an outer tube and an inner cable, each having a pair of free ends. The outer tube is made of a foamed material, such as foamed polyethylene or neoprene rubber, which minimizes the interference with play when stepped upon, The outer tube has an inner channel into which a weighted flexible tube or rod is partially or completely inserted, which assists in laying the rings flat to the ground or playing surface and reinforcing the outer tube.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
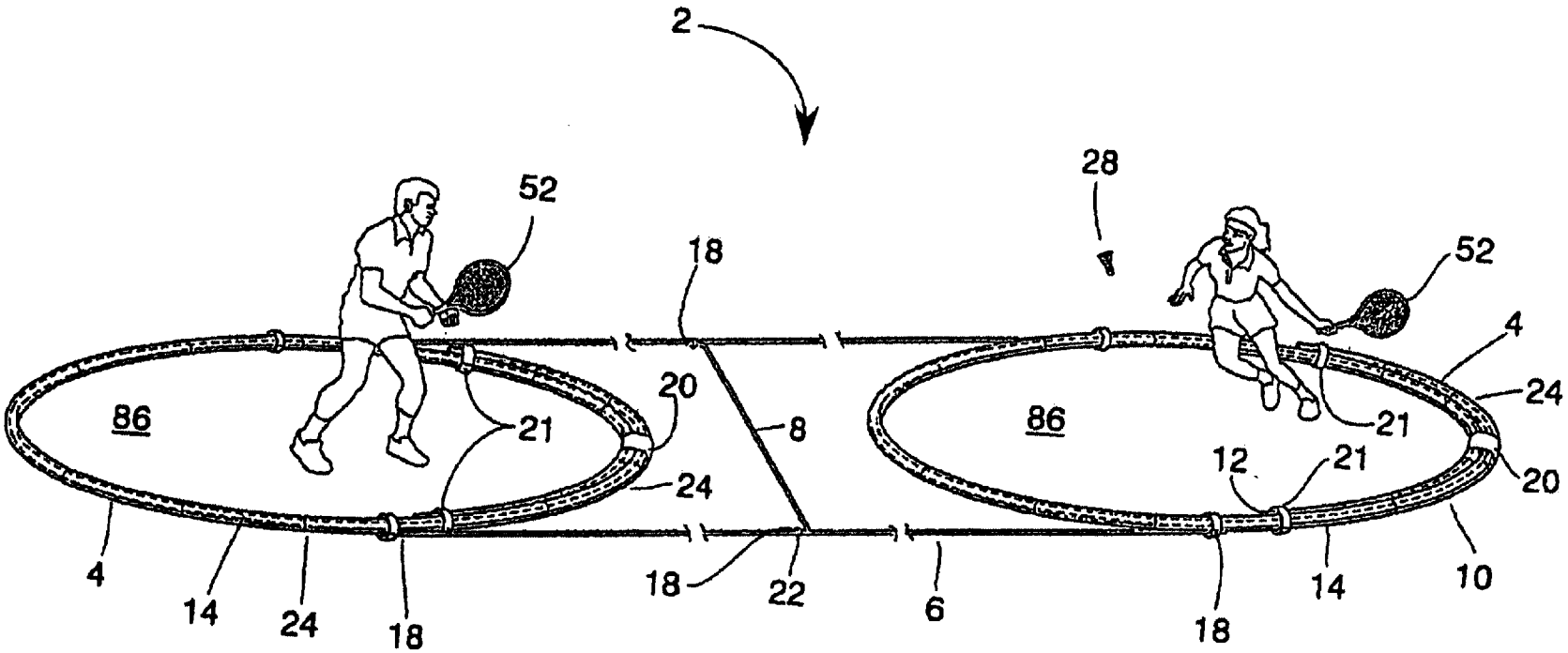
FIG. 1 is an environmental, perspective view of a first embodiment of a game assembly that employs a court, rackets and a shuttlecock according to the present invention.
Figure 2:
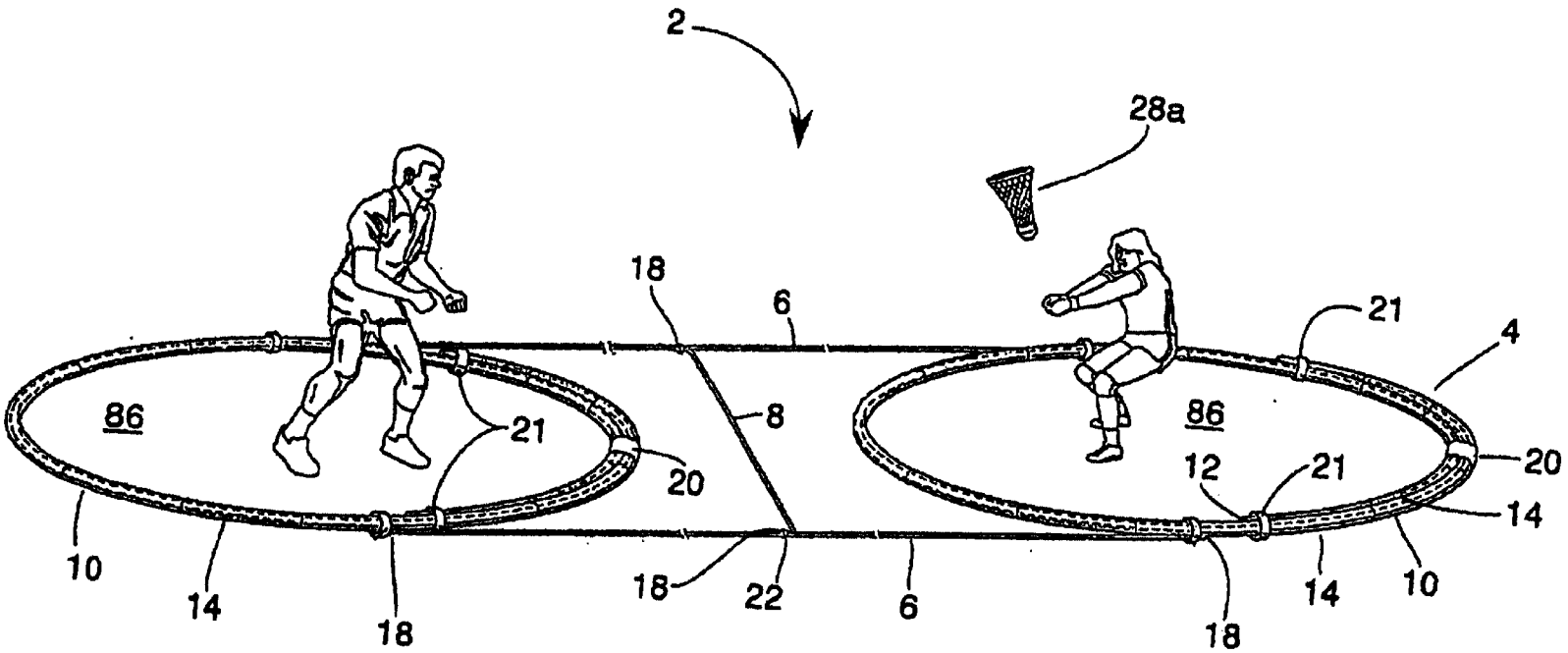
FIG. 2 is an environmental, perspective view of a first embodiment of a game assembly that uses an oversized shuttlecock.

Referring to the figures by numerals of reference, and first to FIGS. 1–2, a game assembly is shown in use as a competitive recreational sport in which opposing players volley a shuttlecock 28 (or play device 28*a* in FIG. 2) within the boundaries and target areas 86 of the court 2. FIG. 1 shows each player using a racket 52, whereas FIG. 2 shows the use of the play device 28*a* being returned by striking it with the use of a player's arms.

The game assembly includes a court 2 which extends longitudinally over a level playing surface. In the preferred embodiments, the court 2 is divided into first and second playing areas, wherein each playing area includes an adjustable ring 4 or a non-adjustable ring 4*a*. Each of the opposed rings (4,4*a*) defines an opponent's target zone 86 into which an opposing player attempts to cause the shuttlecock 28, 28*a* to land. The ropes 6,8 define the boundaries of the court 2.

The rings 4 of the two playing areas are separated from one another by a predetermined distance, preferably 35 feet.

Two side ropes 6, or like materials, connect the opposed rings 4 at opposing points in the diameter of the ring in order to maintain the desired predetermined spacing, and, mark the side boundaries of the court 2 when stretched taut. A center rope 8, or like material, extends transversely to the side ropes 6 and defines a centerline of the court 2. The rope 8 bridges the two side ropes 6 by attaching each free end 18 of the center rope 8 to a mid-section of each of the side ropes 6. An elastic strap 22 closely and tightly encircling the ring 4, or any like temporary banding means, may be used to temporarily secure the free ends 18 to the side ropes 6.

Still referring to FIGS. 1–2, each adjustable ring 4 comprises an outer tube 10 and an inner cable 14. The outer tube 10 is composed of any foamed material such as polyethylene or neoprene rubber. However, the use of polyethylene foam material is preferred.

The outer tube 10 has free ends 12 and is scaled by ruler marking 24 which are imprinted on a rubber strip and adhered to the outer surface of the outer tube 10 for a user to adjust each ring 4 to a desired diameter. The desired diameter and resulting area contained by each ring 4 is determined by and corresponds with the player's height or ability under the rules of game. The preferred rule determining the diameter of the ring 4 is to have the diameter of the ring 4 equal twice the player's height. For example, if the player is 5 feet tall, the diameter of the circular ring 4 may be 10 feet. The ring 4 can be expanded and contracted in a range or 7' to 14' in diameter. The total length of the ring 4 is approximately 45'.

Figure 3:
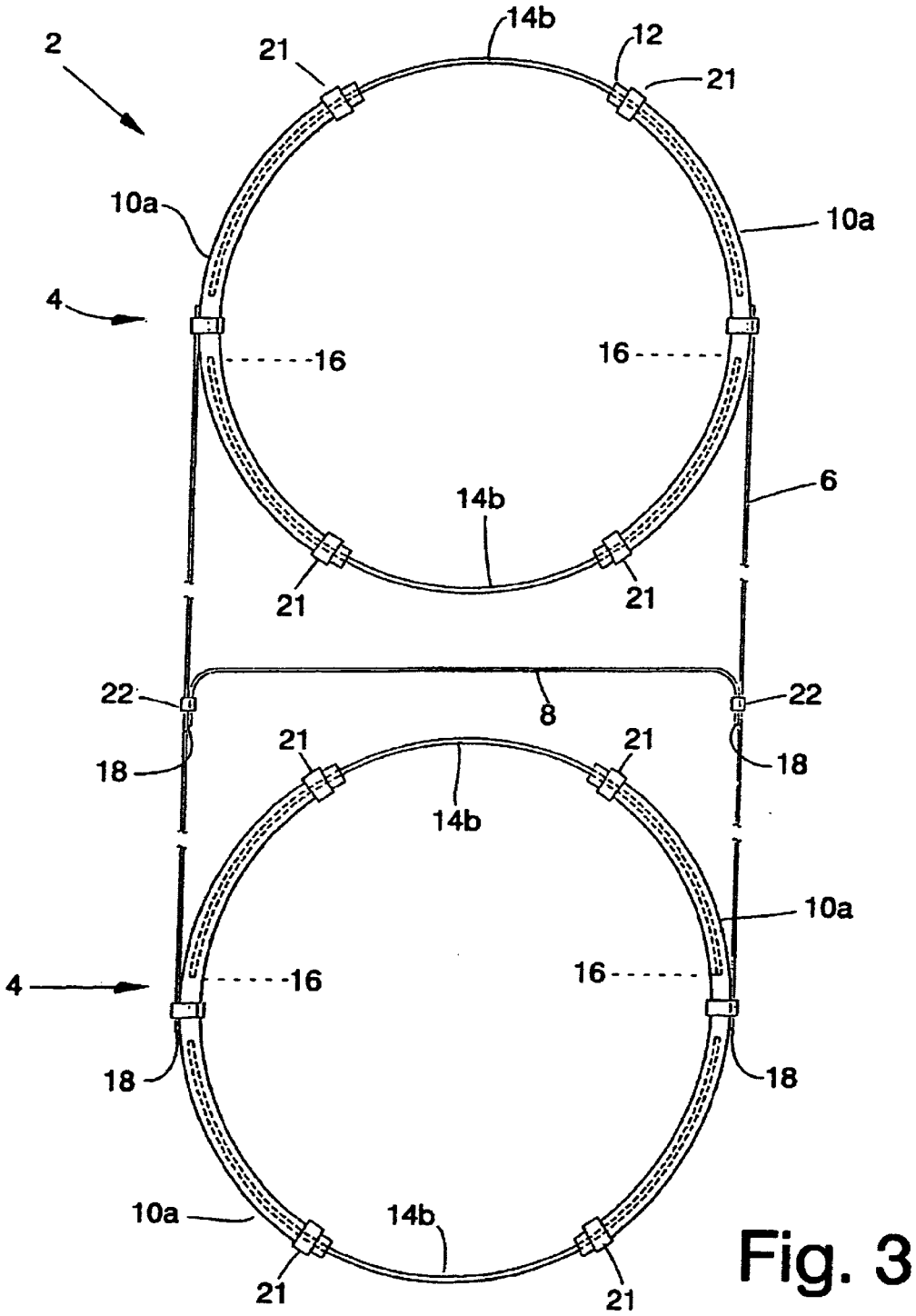
FIG. 3 is a top plan view of a second embodiment of the game assembly that depicts a court ring comprising slidably adjustable inner cables inserted into outer tubes.

Two different embodiments of the means of adjusting the diameter are shown in FIGS. 1 and 3. In FIG. 1, a sleeve 20 is fastened to a body portion of the outer tube 10 and is configured as a loop to permit one of the free ends 12 of the outer tube 10 to slide through freely. A strap 21 made of rubber or like resilient material is used to tightly and frictionally band the free end 12 of the outer tube 10 against the body of the ring having desired diameter, thereby temporarily fixing the ring diameter. Thus, when a user wishes to adjust the ring 4, he or she may simply release the frictional grip of the strap 21 on the free end and adjust the ring 4 diameter accordingly.

To lend weight and rigidity to the outer ring 4, the first embodiment has an inner channel for receiving an inner cable 14. The inner cable 14, or rod, is formed from the group consisting of plastics, metals, or composite materials, which lend some rigidity and weight the ring. Yet, the inner cable 14 is also flexible and bendable so as to be completely secured inside the outer tube 10. Because of the extra weight of the inner cable 14, the outer tube 10 is capable of laying flat upon the playing area and maintaining a substantial circular shape.

Alternatively, as readily seen in FIG. 3, a second preferred embodiment of the present invention includes the ring 4, which comprises a first outer tube 10*a* and second outer tube 10*b* connected together by a first inner cable 14*a* and second inner cable 14*b*. The material used for the tubes of the ring 4 are the same as described above. A free end portion 16 of the first inner cable 14*a* is inserted inside the channel of a free end 12 of the first outer tube 10*a* and is held tightly together by friction. The other free end portion 16 of the same inner cable 14*a* is inserted inside the channel of the free end 12 of the second outer tube 10*b* in the same manner. Likewise, the second inner cable 14*b* is inserted at each of its free ends into the channels of the both outer tubes 10*a*, 10*b*. Thus a rear section of the court 2 is formed having the second inner cable 14*b* received by the channel of the first and second outer tubes, thereby completing the ring 4. Each of the outer tubes 10 together constitute opposing side sections of the ring 4, and thereby forming a ring having a substantial circular shape. There can be straps 21 at each of the junctions of the inner cable 14 and the outer tube 10, thereby more securely locking the inner cable 14 in place.

Similar to the first embodiment, the surface 26 of an inner cable 14*a*, 14*b* is provided with scaled markings 24 for adjusting the diameter of the ring 4, according to the rule preferences previously discussed. To adjust the circular ring 4 by expanding or contracting its diameter, at least one inner cable 14*a* or 14*b* is moved relative to the outer tube's free ends 12. To enlarge the diameter, the inner cable 14 is pulled out to align a desired scaled marking 24 with the free end 12 of the outer tube 10, but not so far as to disengage the inner cable 14 from the outer tubes 10. To reduce the diameter, the inner cable 14 is pushed further inside the free end 12 of the outer tube 10 so that the scaled marking is again aligned with a free end of the outer tube.

An advantage of the second preferred embodiment is that the only straps 22 needed are the ones that are employed to join each free end 18 of the ropes 6, 8 to their desired positions. As described herein above, The force that holds the inner cable 14 and outer tube 10 together when they form the ring 4 is a frictional force between the inner cable and outer tubes.

The structure of court 2 shown in either FIGS. 1–2 or FIG. 3 is easy and simple to maneuver into and within. Thus, the court 2 is favorably used by children, handicapped individuals, amateurs or professionals alike, for playing a competitive or recreational sport. In addition, the court 2 is portable; therefore, relocating the court 2 is relatively effortless.

Figure 4:
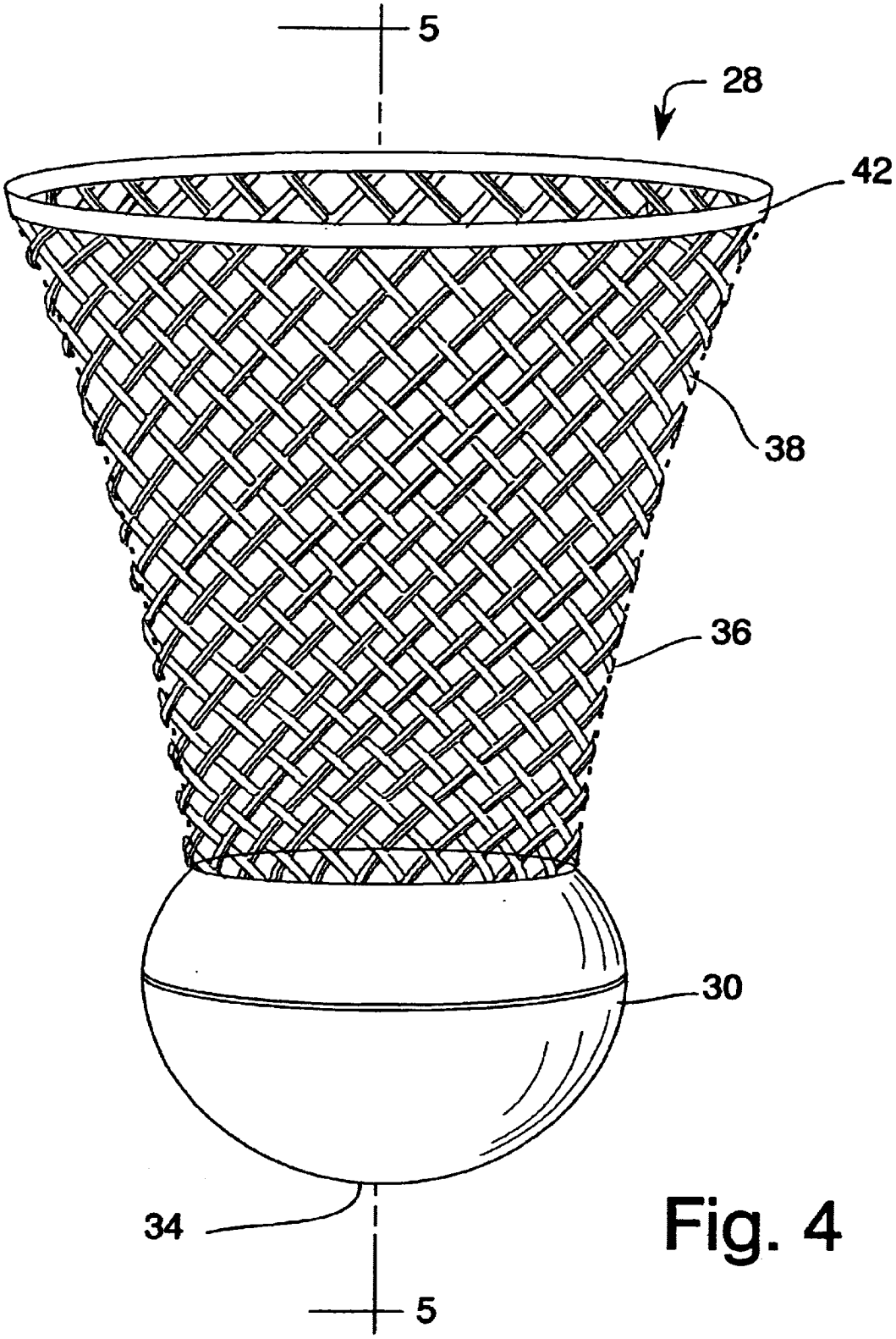
FIG. 4 is a perspective of an improved shuttlecock according to the present invention.

The court may be used in combination with other equipment depending on the desired game to be played. In a first game, opposing players use rackets 52 and a shuttlecock 28, as shown in FIG. 1. As shown in FIG. 4, such shuttlecock 28 includes a skirt 36 adhered within cap 30.

Figure 5:
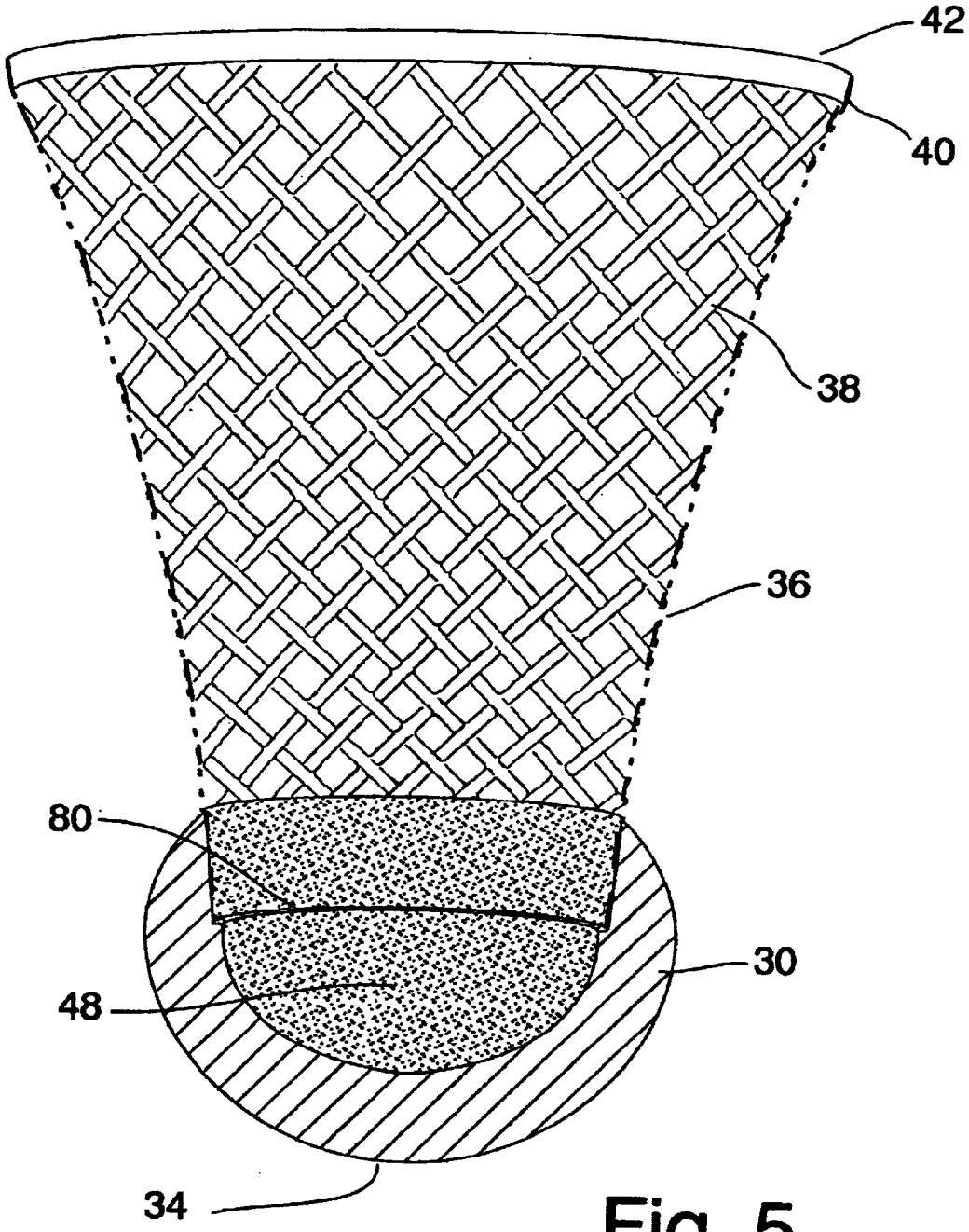
FIG. 5 is a cross-sectional fragmented side view of the improved shuttlecock according to the present invention taken along lines 5—5 of FIG. 4.

FIG. 5 illustrates the shuttlecock 28 in a cross-sectional side view. The cap 30 is composed of a material chosen from the group consisting of rubber, cork, or cork with a leather or rubber covering. The head portion 34 of the cap 30 has added thickness that is produced by graduating the amount of material used. Because the bottom portion 34 is an area most often hit by the racket 52, the extra material formed provides a better response when hit.

The skirt 36 is formed along the lines of a parabolic arc, as indicated by the broken lines, has a first end 80 terminating in the cap 30. The skirt 36 comprises a net of strands 38 extending from the first end 80 to a tail ring 42 at a tail end portion 40, the strands 38 radiating in outwardly spiraling paths and being braided into a netting. Note that, for clarity of illustration, the strands are not shown through the netting to the rear of the shuttlecock.

Figure 8:
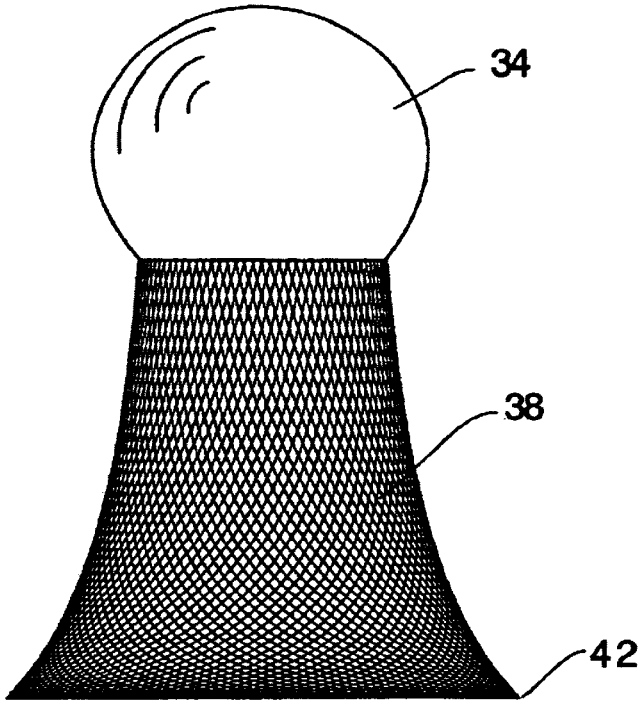
FIG. 8 is a perspective view of a shuttlecock with interwoven strand.
Figure 8A:
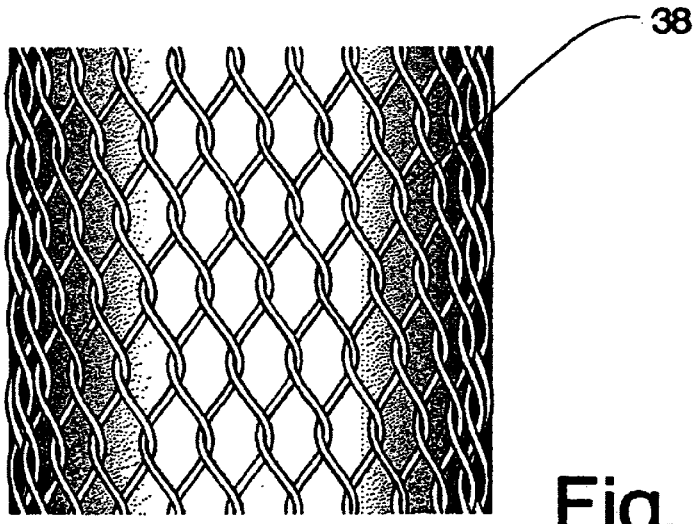
FIG. 8*a* is a close-up view of the interwoven strands of the shuttlecock in FIG. 8.
Figure 12:
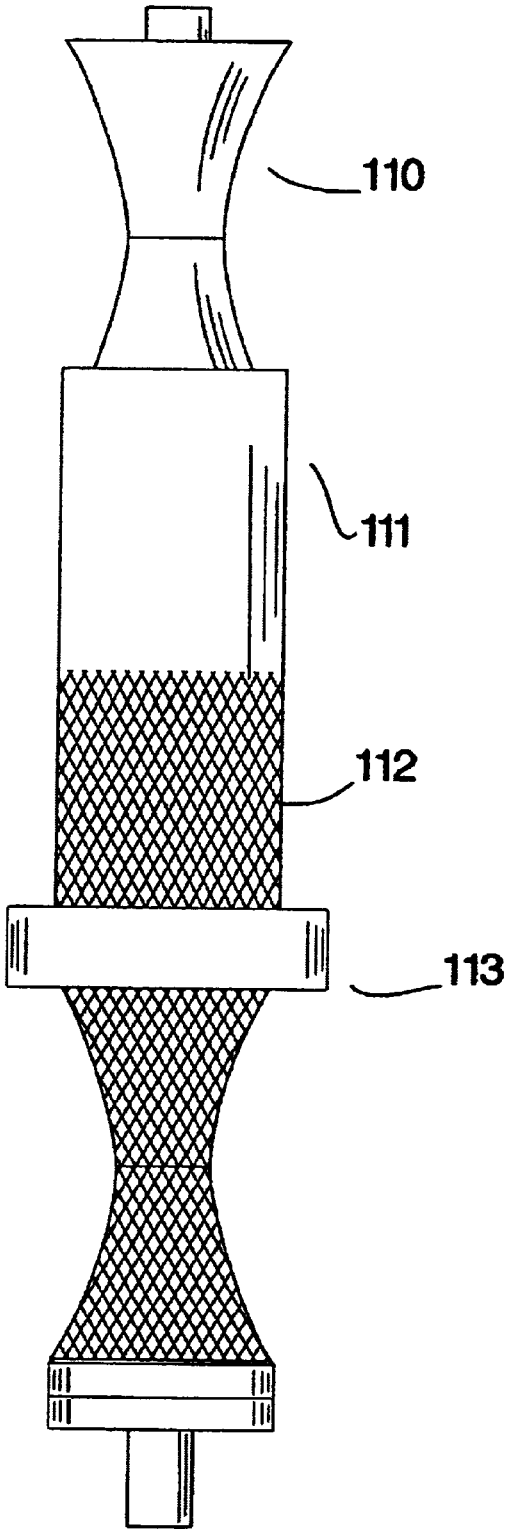
FIG. 12 is a side view of a method of manufacturing tail portions of play devices.

The preferred method of manufacture of such skirts 36 is shown in FIG. 12 the drawing shows the forms 110 being directed through a tube 111 which has around its circumference a length of tubularly woven fabric 112. The fabric is pulled from the tube; through a polymer solution located within a cup 113; by the adjunction of the fabric 112 to the forms 110 as they are being pushed through the tube 111. The fabric goes through a polymer solution located within a cup 113, which is formed by a rubber ring circumventing the tube at it's base. Once the fabric and polymer composite has cured upon the forms to which the composite of materials has been disposed, the form is removed, leaving the interwoven or braided skirt 36 which can then be affixed to a tail ring 42 at the tail end portion 40, resulting in the shuttlecock as shown in FIG. 8. The tail ring 42 is composed of any suitable polymer material or polymer with fibers for strengthening and unifying the tail portion of the strands 38. A preferred embodiment for the tail portion of a play device is shown in FIG. 8*a* and is composed from strands 38, this is a close view of the interlocking strands of material; and shows that the strands of material twist around their neighboring strands along the length of the material being produced. This type of circular interlocking strands of material may also be produced so as to produce a useful rope or tubular reinforcement as well as providing a composite material structure with improved linear, expansion, and compression strength's. The diamond or hexagonal pattern this weave produces is also a preferred pattern for use with an injection molded plastic tail portion of a play device described herein.

Figure 13:
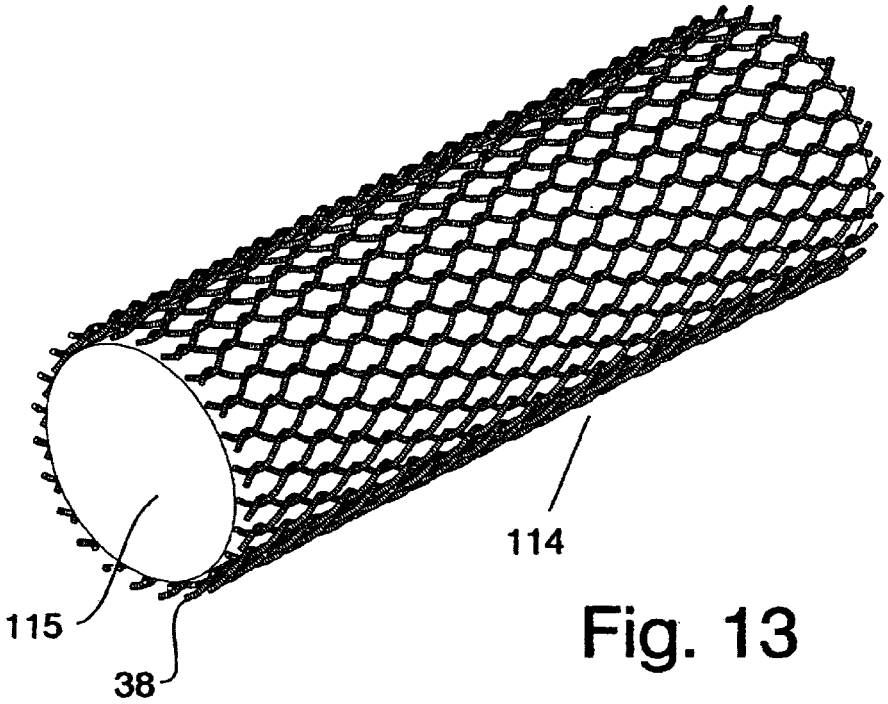
FIG. 13 is a perspective view of "heliwoven" material expanded over a tube.
Figure 14:
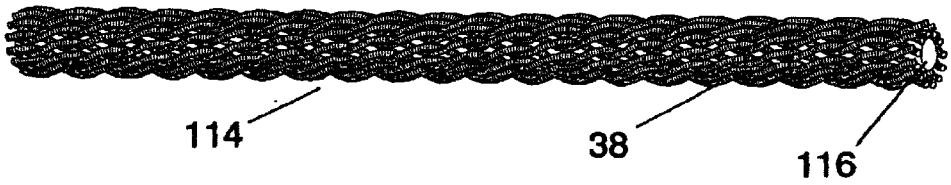
FIG. 14 is a perspective view of "heliwoven" rope with a tube contained within, for purposes of illustration clarity.
Figure 15:
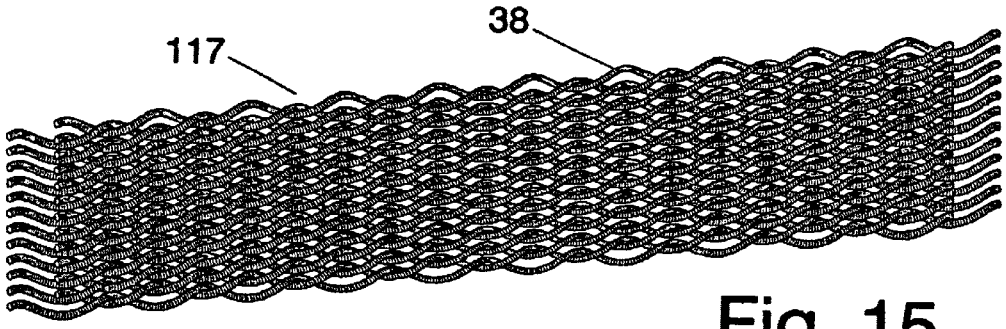
FIG. 15 is a perspective view of flat "heliwoven" material.

FIG. 13 is a perspective view of heliwoven material expanded over a tube 115, the strands 38 twist around their neighboring strands along the length of tubular "heliwoven" material 114. FIG. 14 shows heliwoven material 114 constricted around a tube 116, the illustration is a depiction of heliwoven material; close to it's natural state; in it's natural state heliwoven material 114 is tightly constricted and twists along it's length. The tube 116 has been added for illustration clarity, as the tube would disallow the material to completely constrict into it's natural state; thus allowing the individual strands, 38 and the manner in which they are woven together to remain visible. FIG. 15 shows strands of fibers 38 which have been braided into a flat material 117, the strands of fibers twist around their neighboring strands in the same manner as the tubular heliwoven strands, the only difference being; that a set of strands do not twist around their neighboring strands, there-by disallowing the material to create a tube and causing the fabric to lay flat, this type of flat heliwoven material provides a good fabric structure for use with polymers to produce composite structures.

Figure 16:
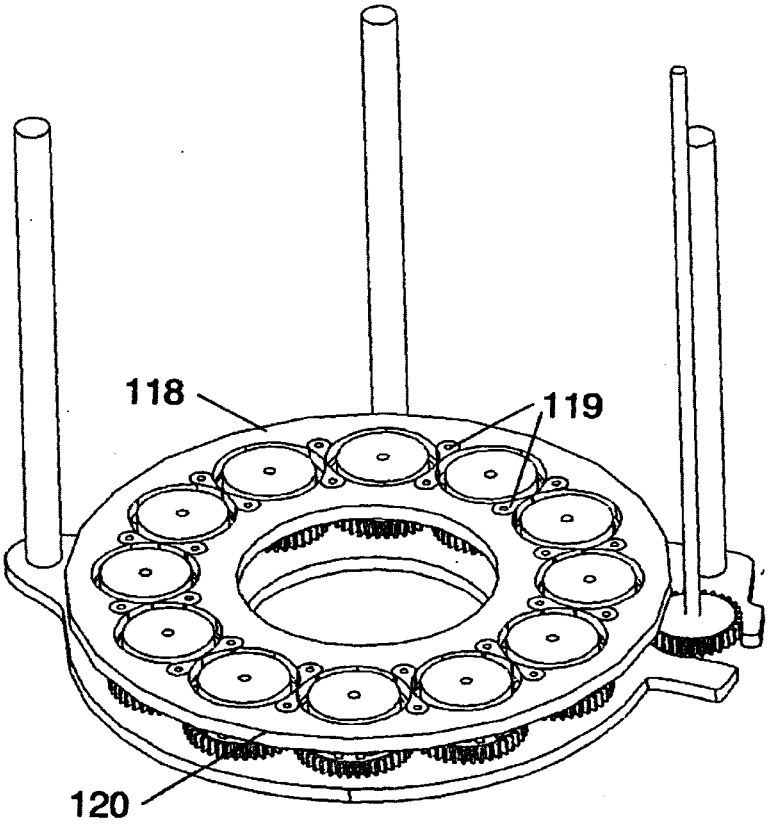
FIG. 16 is a perspective view of a braiding machine which has been adapted to produce heliwoven material.

FIG. 16 shows a circular braiding machine 118 which has been adapted to produce heliwoven material 117 & 114. The embodiment shows cams 119, which allow a braiding machine to be programed to produce standard tubular or flat braided material as well as other types of braids or "heliweaves". The cams are a movable part of the braiding table 120, they are designed to rotate a small amount along an axial plane perpendicular to the surface of the table 120, and would be programed to transfer or retain, the carriers which contain the strands of material, to and from selected paths upon the braiding table 120, there-by creating different types of braided patterns. For instance if the spindles carrying the strands of fibers twist around their neighboring strands more than once, the strands of material lock together tighter; forming a more stable braid. This type of helibraid produces a hexagonal pattern, when the material is expanded over tubes or shapes, as apposed the diamond pattern produced by a standard heliweave, as depicted in FIGS. 8, 8*a* & 12.

The flow through aerodynamic characteristics of the curved bell shape of the interwoven skirt 36 provides a desirable flight characteristic to the play devices. The parabolic arced skirt 36 also increased the shuttlecock's compression strength so as to effectively prevent the skirt 36 from easy deformation under the stress of hitting.

Figure 6:
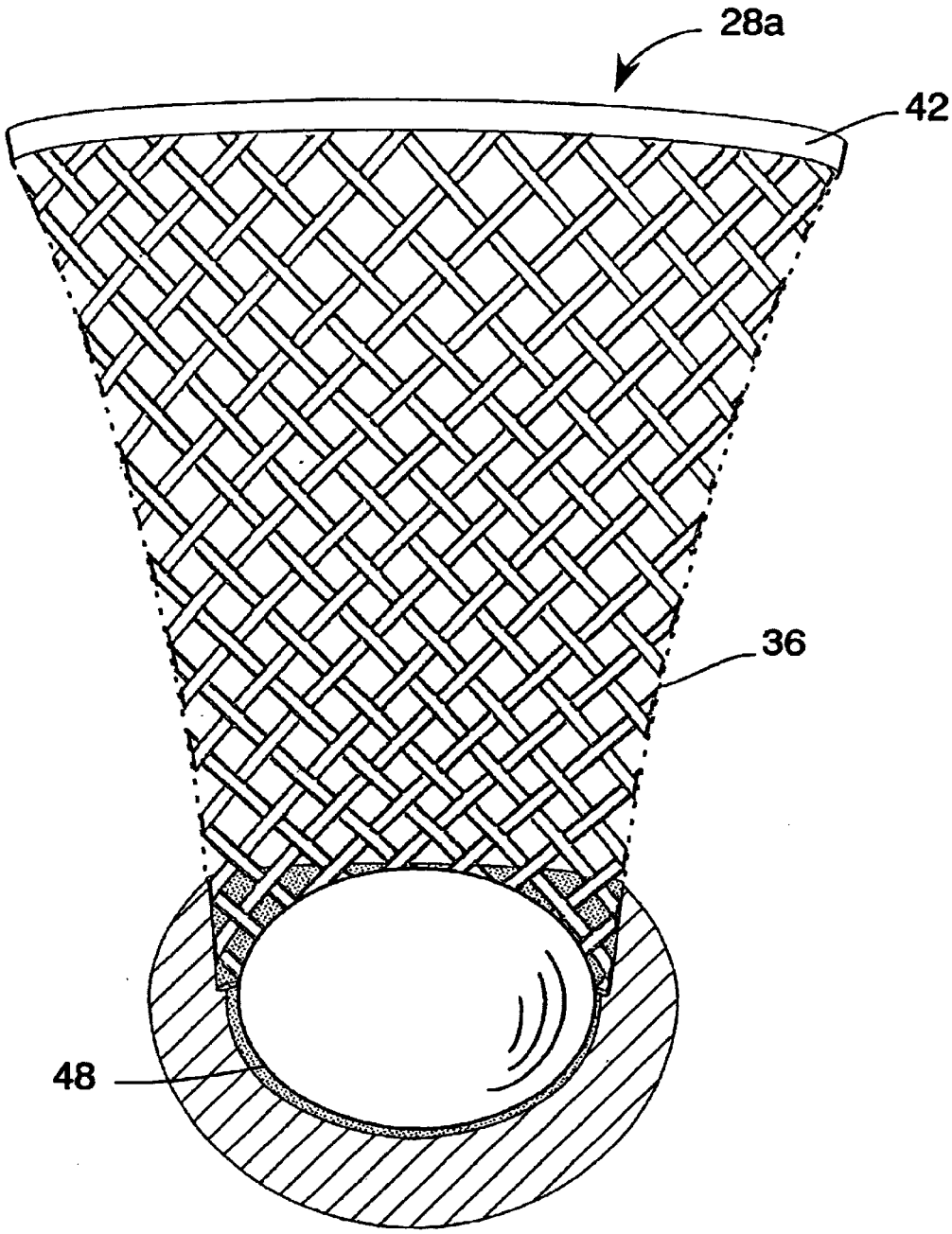
FIG. 6 is a cross-sectional, fragmented side view of an enlarged shuttlecock according to the present invention, showing a foamed rubber cap surrounding an inflatable bladder.

According to another preferred embodiment of the invention of FIG. 6, the shuttlecock 28*a* is enlarged or oversized and has a dimension that is between 2 to 8 times larger than a normal shuttlecock 28*a* that is normally used in a badminton game. The tail ring 42, the cap 30 and the skirt 36 are made in the same manner as described above. However, the cap 30, may be produced with an inflatable material, foamed rubber, or foamed plastic and may have a core 48 that includes an inflatable bladder 50 so as to provide an extra responsiveness when hit by any body parts of the player.

Figure 7:
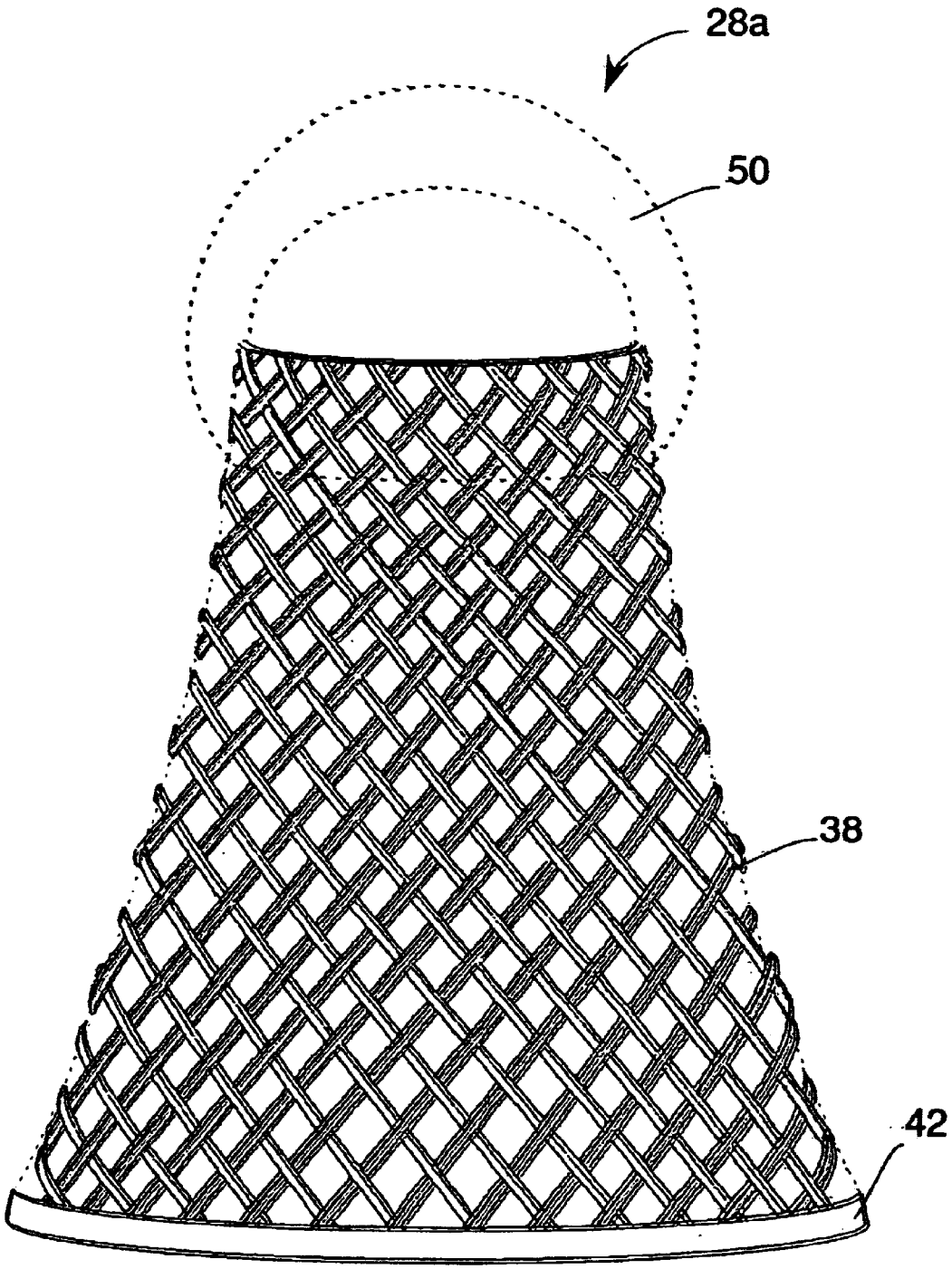
FIG. 7 is a partial, perspective view of another embodiment of an enlarged shuttlecock with a foamed rubber or foamed plastic head shown in phantom lines.

The play device 28*a* may have a foam head without a bladder, as readily seen in FIG. 7. If there is a bladder, it may lie or be adhered within a pocket of the foamed rubber head. The head may also be produced from an inflatable vinyl material and may have a soft material affixed to its outer surface.

Figure 9:
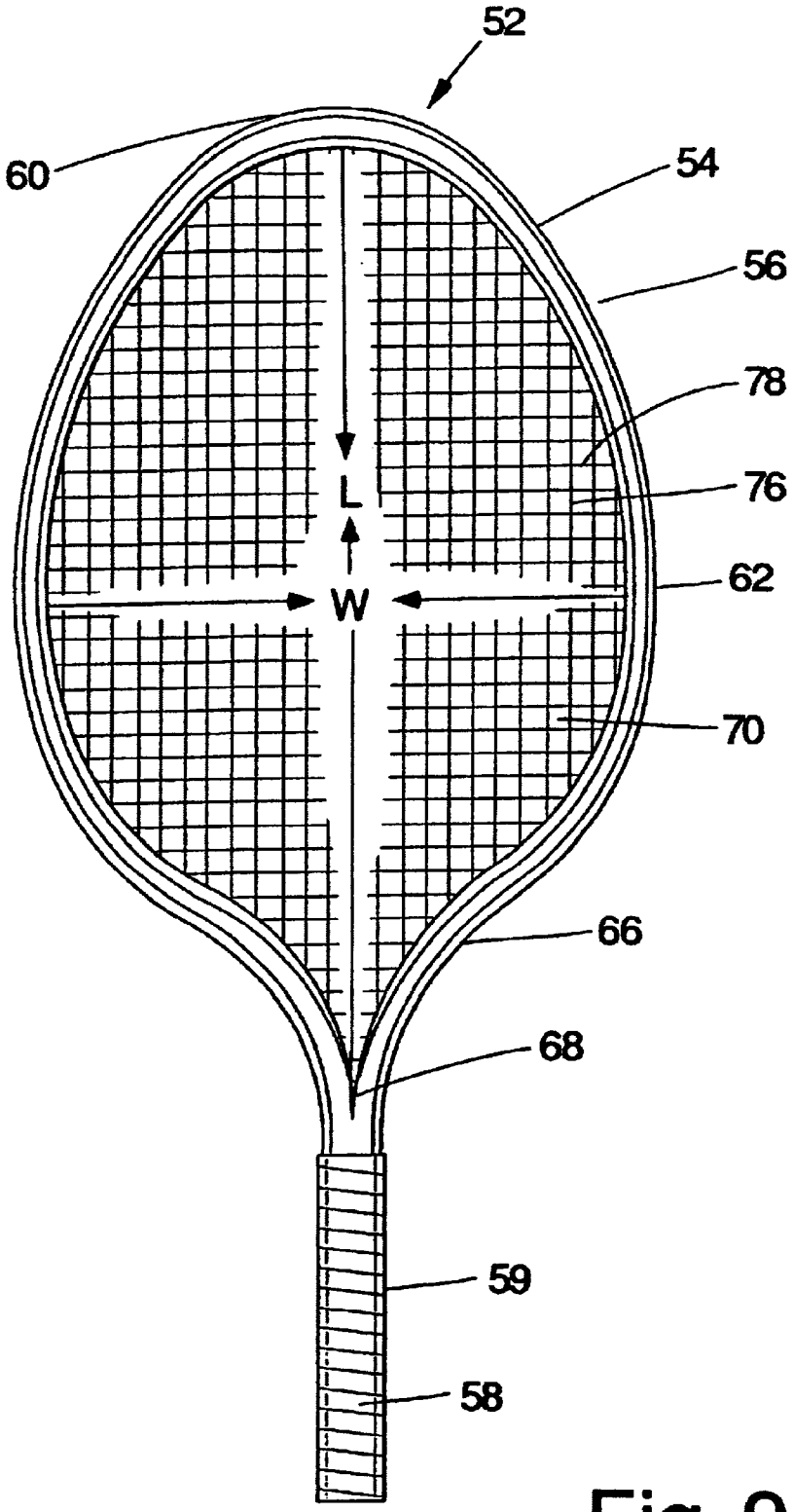
FIG. 9 is a perspective view of an improved racket according to the present invention.

Referring now to FIG. 9, and improved racket 52 of the invention includes a frame 54. The frame 54 has symmetrical shape with respect to a longitudinal axis 72. The frame 54 includes a head portion and a handle portion. The head portion forms a head 54 of the racket 52 and the handle portion forms a handle 58 of the racket 52. The head 56 and the handle 58 are integrally connected with each other at a throat portion 68. The handle is provided with a grip 59.

The frame 54 has a tip portion 60, a mid-section and an end section 66, wherein the end section 66 is directly and gradually connected to the throat portion 68. The head 56 defines an interlaced string area 70 that includes longitudinally and transversely extending strings 78. The transversely extending strings 78 are equally spaced from one another and completely cover the entire string area 70. Unlike the conventional racquet, the transverse strings terminate at the beginning of the end section 66, and only the longitudinal strings 76 join the throat portion 68 of the racquet.

Moreover, the head 56 has a face which defines a width W of the racket's head 56 by measuring the distance between symmetrically opposite points along the sides 62. A length L of the racket's head 56 is measured from the tip portion 60 to the throat portion 68, wherein the head 56 has a widest area between the mid-section and the end section 66. Because the widest area is close to the throat portion 68 of the frame 54, a player can respond with hits that are quicker and more accurate. Essentially, the sweet spot or the string area 70 of the racket 52 is expanded and located closer to the handle of the racket. The racket 52 has a ratio of a width W to a length L of the head 56 as measured at its widest and longest points, the ratio being about 0.60. In addition, the frame 54 of the racket 52 may be made from one of the materials chosen from a group consisting of metal, plastic, or composite laminates such as graphite and epoxy resins.

Figure 10A:
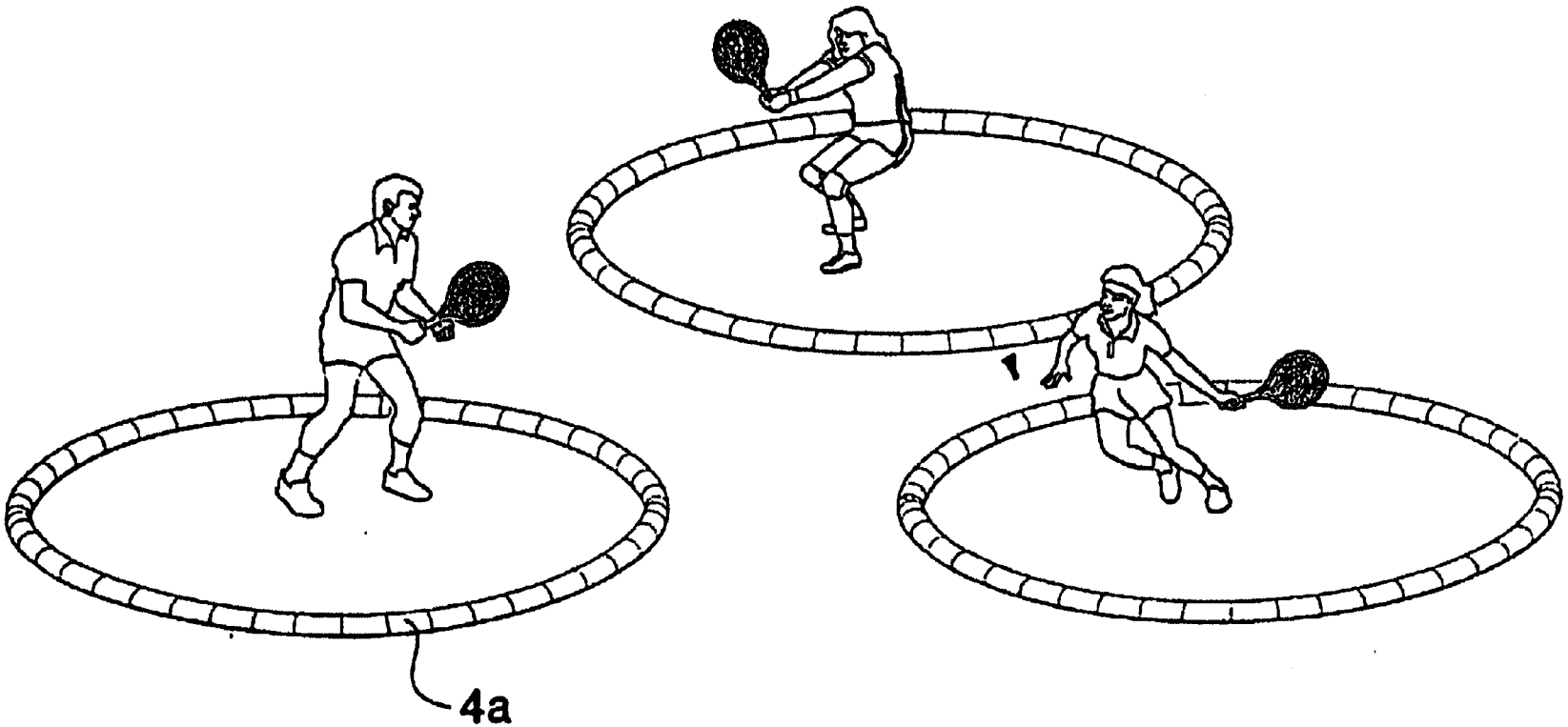
FIG. 10A is an environmental view of a game court with three non-adjustable rings according to the present invention.
Figure 10B:
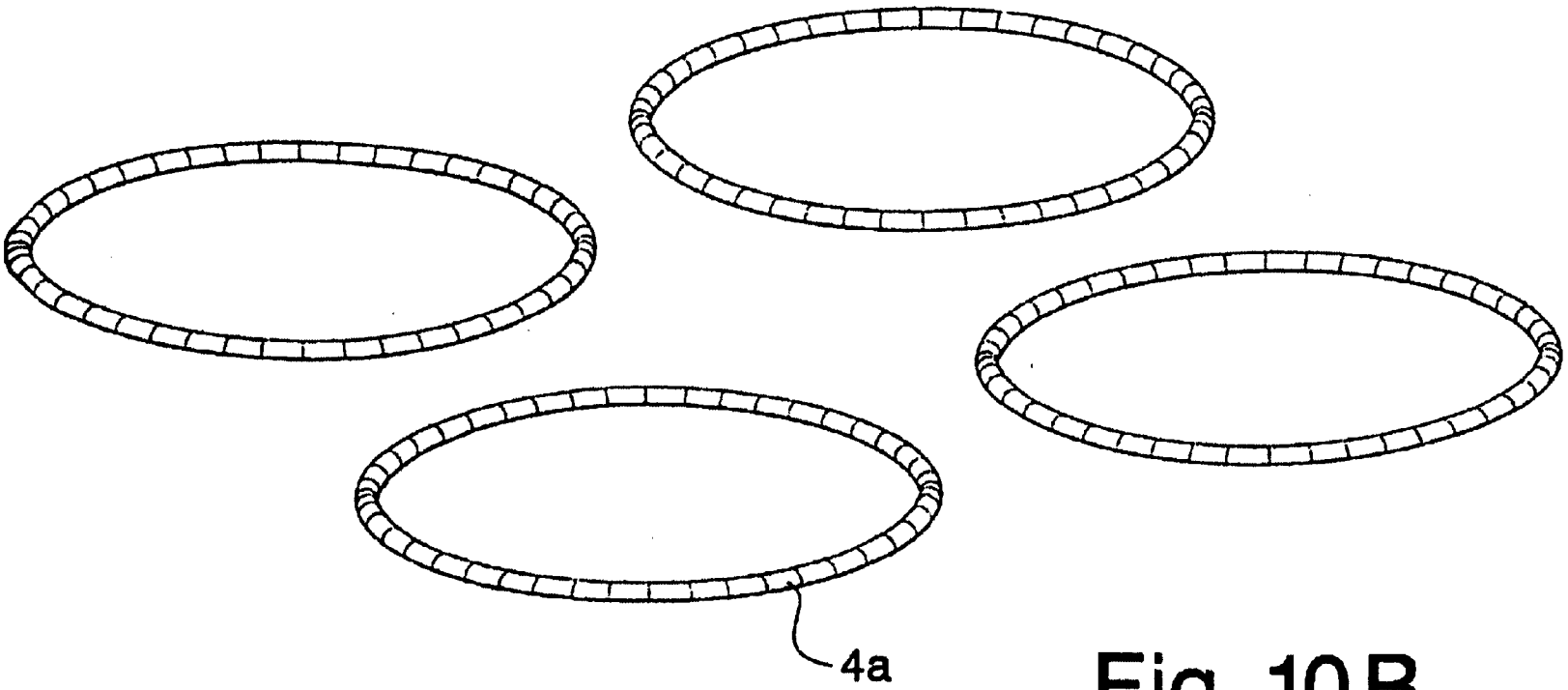
FIG. 10B is an environmental view of a game court with four non-adjustable rings according to the present invention.
Figure 10C:
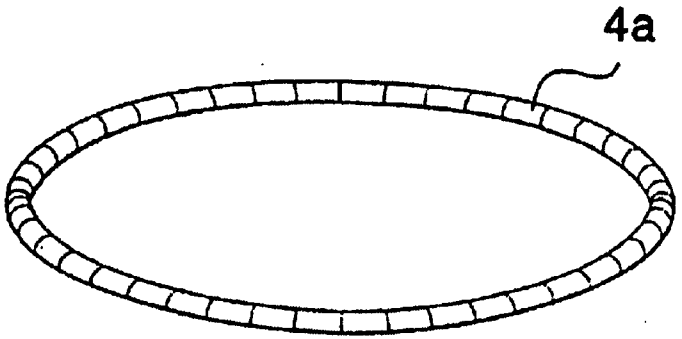
FIG. 10C is an environmental view of a game court with two non-adjustable rings according to the present invention.
Figure 10C:
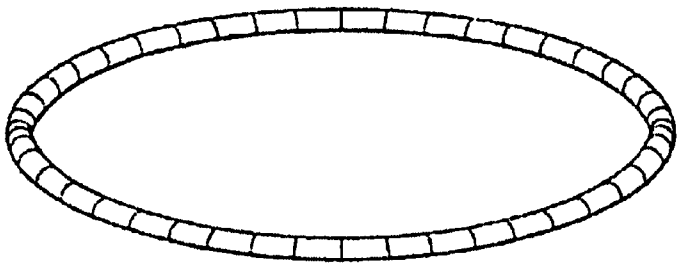
Figure 11:
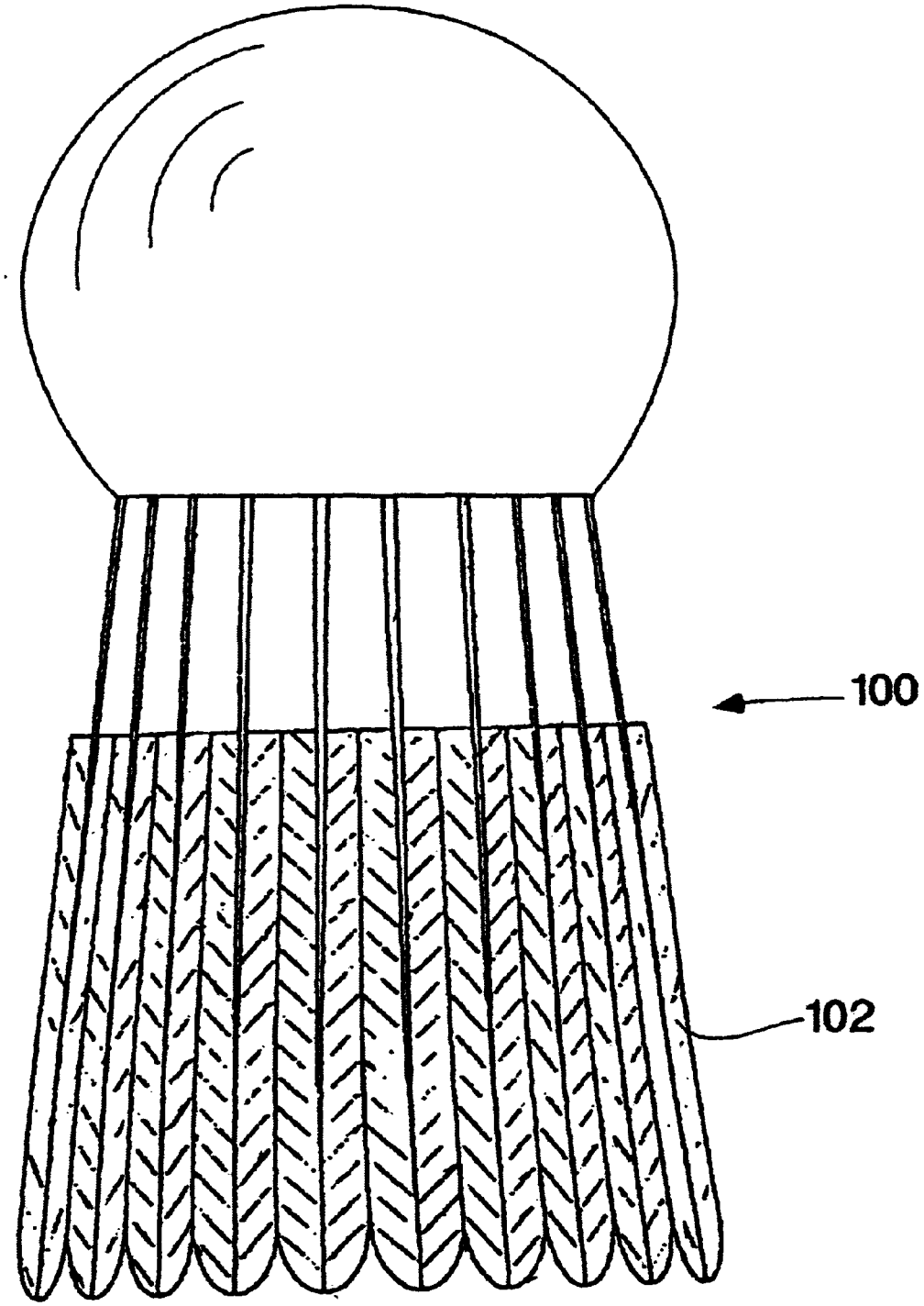
FIG. 11 is a side view of an alternate embodiment of the tail portion of the shuttlecock according to the present invention.

FIGS. 10A, 10B, and 10C depict playing areas or courts using non-adjustable rings 4*a*. The non-adjustable rings 4*a* are constructed in the same manner as the adjustable rings 4. The non-adjustable rings make setting up the playing court extremely fast and convenient. The non-adjustable rings 4*a* can be used with any of the embodiments of the present invention, however, they are preferably used with the oversized shuttlecock 28*a*. FIG. 11 shows an alternative configuration for the tail portion 102 of the play device 100. This embodiment depicts a plastic injection molded tail portion, with a feather like pattern running along the length of the tail portion. This type of embodiment may be produced in sections, so that along the length of the tail portion; substantial sections of the tail are disjointed from neighboring sections, there-by mimicking real feathers. The sections may be twisted or curved along their length so as to deflect air and cause the play device to spin while in flight. The top portion of this type of embodiment must be made light and flexible, without hard edges, so that a player when hitting the foam head with a body part does not intersect hard plastic causing undo pain upon body parts. The soft foam heads may be adhered to the tail portion or integrally molded to the tail portion or the head may be produced from a soft flexible injection molded plastic and may be injection molded along with the tail portion in a two shot injection molding process where the tail portion is injected with one type of plastic and the head injected with a different type of plastic material, this would produce a single structure; head and tail combined with different densities of materials comprising the head and tail portions of a play device. Another method of producing the tail portion would be to compression mold strands of plastic material which have been extruded into a tubular mesh. The strands of plastic; along the length of tubular plastic mesh; would form a diamond, hexagonal, or other pattern, which would allow the tubular plastic strands to expand over bell shaped forms. To compression mold the tubular plastic mesh; the mesh would be heated while disposed upon a form and then be compressed by a mirroring form. The plastic mesh, which the molds had compressed, when cooled, would retain the desired shape of a tail portion of a play device.

In a preferred embodiment, the oversized shuttlecock 28*a* has a length to width ratio of 2 to 1. However, other ratios can be used, for example, a 3 to 1 ratio. The cap 30 of a play device (28*a*, 100) may be made from a polyurethane foam. The rings (4,4*a*) may be constructed of polyethylene foam with a wire cable inside to provide weight and stability, alternative methods and materials may be used to produce the rings, which are used in conjunction with the play devices.

The sports game of the present invention provides participants with an invigorating and exhilaration experience, and an excellent cardiovascular workout. Game participants benefit from improved eye, hand, and foot coordination as well as improved concentration skills. The sports game of the present invention teaches participants to both quickly think and react.

The preferred embodiments of the present invention disclosed herein are intended to be illustrative only and are not intended to limit the scope of the invention. It should be understood by those skilled in the art that various modifications and adaptations of the present invention as well as alternative embodiments of the present invention may be contemplated, for example, any type of molded plastic, or knit fabric could be used to make the tail portion of the play device. It is to be understood that the present invention is not limited to preferred embodiments described above, but encompasses any and all embodiments within the scope of the following claims.

I claim:

1. A play device for game, designed to be struck with different parts of the human anatomy;

comprising an uppermost striking portion which is composed of an inflatable bladder, foamed rubber or foamed plastic, or an inflatable bladder located within a substantially round foam head;

wherein said striking portion is formed into a substantially hollow, substantially round head and is affixed to a tail portion which consists of strands of material which are combined to produce a curved bell shaped mesh, the length of which is defined by a parabolic arc;

wherein the parabolic arc formed along the length of the tail portion facilitates an increase in the impact strength of a tail portion of the play device;

wherein the tail portion's height is approximately equal to its greatest width, with the most constricted circumference of the tail portion of the play device being approximately half the diameter of the most expanded portion of the play device;

the weight of the head portion being approximately twice that of the tail portion.

2. The play device as described in claim 1 comprising a tail portion which consists of fabric and polymer composite strands of material which are combined to produce a semi-rigid composite structure, producing a curved bell shaped mesh;

the length of which is defined by a parabolic arc.

3. The play device as described in claim 1 wherein the expanded base of said structure has a tail ring for strengthening and unifying the ends of the strands of fiber which are used to produce the tail portion of the play device.

4. The play device as described in claim 1 wherein the strands of material used to form the tail consist of a lattice of injection molded or compression molded plastic.

5. The play device as described in claim 1 wherein said tail portion is composed of strands of material radiating out and away from the head portion in opposing spiraling paths creating a diamond shaped hole pattern along the length of the tail portion.

* * * * *